United States Patent [19]

Hamada et al.

[11] Patent Number: 5,017,842

[45] Date of Patent: May 21, 1991

[54] IMAGE DISPLAY APPARATUS

[75] Inventors: Kiyoshi Hamada, Sakai; Kinzo Nonomura, Ikoma; Masayuki Takahashi, Katano; Jumpei Hashiguchi, Suita; Satoshi Kitao, Kyoto, all of Japan

[73] Assignee: Matsushita Electric Industrial Co., Ltd., Osaka, Japan

[21] Appl. No.: 518,407

[22] Filed: May 3, 1990

[51] Int. Cl.[5] ..... G09G 1/04; H01J 29/70

[52] U.S. Cl. ..... 315/366; 315/369; 313/422

[58] Field of Search ..... 315/366, 369; 313/422, 313/437

[56] References Cited

U.S. PATENT DOCUMENTS 4,118,651 10/1978 Scott ..... 313/422
4,451,846 5/1984 Iyehara et al. ..... 358/56
4,622,497 11/1986 Miyama et al. ..... 315/366

FOREIGN PATENT DOCUMENTS 57-135590 8/1982 Japan .
2129838 5/1990 Japan .

*Primary Examiner*—Gregory C. Issing
*Attorney, Agent, or Firm*—Stevens, Davis, Miller & Mosher

[57] ABSTRACT

An image display apparatus which controls electron beams emitted from an electron source by electrodes having an arrangement of electron beam passage apertures and displays an image by irradiating the electron beams onto phosphors on a screen. The image display apparatus includes a means which changes at least a position of the electron beam passage aperture of a second electrode of the electrodes corresponding to the electron beam passage aperture of a first electrode of the electrodes in accordance with the position on the screen and controls the potential difference between the two electrodes, thereby making it possible to control the landing position of the electron beams on the screen.

10 Claims, 4 Drawing Sheets

QUANTITY OF POSITIONAL DEVIATION OF ELECTRON BEAM PASSAGE APERTURES BETWEEN THE HORIZONTAL FOCUSING ELECTRODE AND THE HORIZONTAL DEFLECTION ELECTRODE

IMAGE DISPLAY APPARATUS

BACKGROUND OF THE INVENTION

1. Field of the Invention

The present invention relates to fluorescence for an image display apparatus which is used for a color television receiver, a terminal display of a computer and the like.

2. Description of the Related Art

As a panel-type color display apparatus for displaying a color image, there is a color display apparatus which utilizes cathode luminescence as disclosed in Japanese Patent Application Kokai (Laid-Open) No. JP-A-57-135590. This display apparatus will be explained below. FIG. 4 shows the basic configuration of this display apparatus. Configuration elements of the apparatus are, in order from the backside to the front, that is, in the order from the left side to the right side in FIG. 4, a back electrode 51, a linear cathode 52 as a beam source, vertical focusing electrodes 53*a* and 53*b*, a vertical deflection electrode 54, a beam modulation electrode 55, a horizontal focusing electrode 56, a horizontal deflection electrode 57, a beam acceleration electrode 58 and a screen 59, which are all accommodated in a vacuum flame glass bulb (not shown). The linear cathode 52 as a beam source is stretched or elongated in a horizontal direction so as to generate an electron beam which linearly distributes in the horizontal direction, and a plurality of linear cathodes 52 are provided in a vertical direction with a suitable distance therebetween (only four linear cathodes $52a_1$ to $52d_1$ are shown in the drawing). Assume that there are fifteen such linear cathodes provided in this case. These linear cathodes are structured by coating an oxide cathode material on the surface of a tungsten wire of 10 to 20 $\mu m\phi$, for example. These linear cathodes are so controlled that an electron beam is emitted from each of them for a predetermined time sequentially starting from the linear cathode $52a_1$, as described later. The back electrode 51 restricts generation of an electron beam from the linear cathodes 52 other than the linear cathode 52 which is being controlled to emit an electron beam for a predetermined time, and the back electrode 51 also operates to transmit the generated electron beam only in the forward direction. The back electrode 51 may be formed by coating a conductive material on the inner surface of the rear wall of the glass bulb. Instead of the electron beam source which is constituted by the linear cathode 52 and the back electrode 51, a plane electron source may also be used. The vertical focusing electrode 53*a* is a panel-shaped electrode which has a long slit 60 in the horizontal direction, facing each of the linear cathodes $52a_1$ to $52d_1$. The vertical focusing electrode 53*a* takes out the electron beam emitted from the linear cathode 52 through the slit, and focuses the beam in the vertical direction. The slit 60 may be constructed by crosspieces arranged at suitable intervals, or by a string of many piercing holes arranged at small intervals in the horizontal direction. The vertical focusing electrode 53*b* also has a similar structure.

A plurality of vertical deflection electrodes 54 are disposed in the horizontal direction at intermediate positions of the slits 60. Each of the vertical deflection electrodes 54 has conductors 63*a* and 63*b* which are disposed on the upper and lower surfaces of an insulation substrate 62 respectively. A vertical deflection voltage is applied between the facing conductors 63*a* and 63*b*, and the electron beam is deflected in a vertical direction. In this case, an electron beam from one linear cathode is deflected in a vertical direction at positions of sixteen lines by a pair of conductors. Fifteen pairs of conductors corresponding to the fifteen linear cathodes 52 are structured by sixteen vertical deflection electrodes 64. As a result, electron beams are deflected so that 240 horizontal lines are drawn on the screen 59.

Each of the beam modulation electrodes 55 is constituted by a strip-shaped electrode having a slit in the vertical direction, and a plurality of the beam modulation electrodes 55 are arranged in the horizontal direction with a predetermined distance therebetween. In this case, 320 beam modulation electrodes 55*a* to 55*n* are provided (only ten beam modulation electrodes are shown in the drawing.) Each of the beam modulation electrodes 55 separates the electron beam in each one picture element and takes it out in the horizontal direction, and modulates the quantity of electron beams passed by an image signal for displaying 320 beam modulation electrodes 55, it is possible to display 320 picture elements per one horizontal line. Each picture element is displayed by a phosphor of three colors including R, G and B in order to make a color image display. Each image signal of R, G and B is sequentially added to each beam modulation electrode. 320 sets of image signals for one line are simultaneously applied to the 320 beam modulation electrodes 55, and the image for one line is displayed simultaneously.

The horizontal focusing electrode 56 is a panel-shaped electrode 67 which has a plurality (320 pieces) of slits 66 elongated in the vertical direction, facing the slits 64 of the beam modulation electrode 55. The horizontal focusing electrode 56 focuses, in the horizontal direction, each of the electron beams for each picture element separated in the horizontal direction, and forms a fine electron beam.

The horizontal deflection electrode 57 is constituted by a plurality of conductive panels 68 which are disposed in the vertical direction at intermediate positions of the respective slits 66. A horizontal deflection voltage is applied between the respective conductive panels 68 to deflect an electron beam of each picture element in the horizontal direction and to sequentially irradiate each of the phosphors R, G and B to produce light emission on the screen 59. The deflection width in this case is the width of one picture element for each electron beam.

The acceleration electrode 58 is constituted by a plurality of conductive panels 69 which are provided in the horizontal direction at positions similar to the positions of the vertical deflection electrode 54, and the acceleration electrodes 58 accelerate electron beams so that the electron beams impinge on the screen with sufficient energy.

The screen 59 is constituted by a glass panel 71 whose rear surface is coated with a phosphor 70 that emits light by the irradiation of an electron beam, and also by a metal back layer (not shown). A pair of phosphors 70 which includes three colors of R, G and B are provided for one slit 64 of the beam modulation electrode 55, that is, for each one electron beam separated in the horizontal direction, and the phosphors are coated in a stripe shape in the vertical direction. In FIG. 4, broken lines entered in the screen 59 show sections in the vertical direction which are displayed corresponding to each of the plurality of linear cathodes 52, and two-dotted chain lines show sections in the horizontal direction which are displayed in correspondence with each of the plurality of beam modulation electrodes 55. Each one section separated by these lines include the phosphor 70 (G, R, G) for one picture element in the horizontal direction and a width of 16 lines in the vertical direction, as shown in an enlarged drawing in FIG. 5. The size of one section is, for example, 1 mm in the horizontal direction and 16 mm in the vertical direction.

It should be noted that, in FIG. 4, the length in the horizontal direction is shown to be much larger than the length in the vertical direction, to facilitate understanding.

Although only one pair of phosphors 70 for R, G and B are shown for only one picture element of one beam modulation electrode 55, that is, for one electron beam, in this case, two or more pairs of phosphors for two or more picture elements may be provided, in which case image signals of R, G and B for the two or more picture elements are sequentially applied to the beam modulation electrode and horizontal deflection is also performed in synchronism with this operation.

The display apparatus according to the prior art, however, has the following problems. There occurs a positional deviation between the pitch in the horizontal direction of an electron beam irradiated on the screen and the phosphor stripe pitch, which is attributable to a positional deviation between the phosphor stripe pattern on the screen 59 and the electrode groups which comprises the beam modulation electrode 55, horizontal focusing electrode 56, horizontal deflection electrode 57 and other electrodes.

One of the causes for the above problems is positional deviation between the screen and the electrode group in the process of fabrication of a display apparatus. For example, the screen 59 is formed on the glass panel, and the glass panel usually contracts whenever it undergoes a heat process and has a possibility of contraction by tens of $\mu$m in the case of a glass panel which has a length of 30 to 40 cm. The value of contraction is not constant. Accordingly, there occurs a change in the pitch of the phosphor stripe pattern.

A second cause is a thermal expansion difference between the screen 59 and the electrode group at the time of displaying an image, 42—6 alloy (42% Ni, 6% Cr, balance Fe) and the like, of which coefficient of thermal expansion is close to that of glass, is used as the material for the electrode group, but it is difficult to maintain both the electrode group and the screen at the same temperature in the image display state. Therefore, there occurs a deviation between the pitch in the horizontal direction of the electron beam irradiated on the screen and the phosphor stripe pitch. There is also a possibility that this deviation changes with time due to temperature changes.

A warp of the electrode group or the screen is also another cause. In respect of the individual structure of the electrode group and the screen, the slit pitch precision of the electrode group and the phosphor stripe pitch precision of the screen will also become a problem.

For the above reasons, the pitch in the horizontal direction of the electron beam irradiated onto the screen does not match the phosphor stripe pitch. When the electron beam and the phosphor stripe in the horizontal direction are positioned at the center in the horizontal direction of the display apparatus, pitch errors are accumulated at both ends and there occurs a color deviation at the center.

SUMMARY OF THE INVENTION

It is an object of the present invention to provide an image display apparatus which solves the above-described conventional problems and which can obtain a uniform and satisfactory image.

In order to achieve the above object, the image display apparatus of the present invention controls electron beams emitted from the electron source by using electrodes having an arrangement of electron beam passage apertures and displays an image by irradiating the beam onto the phosphors on the screen, wherein the apparatus includes a means which at least changes a position of the electron beam passage aperture of a second electrode of the electrodes corresponding to the electron beam passage aperture of a first electrode of the electrodes in accordance with the position on the screen and controls the potential difference between the two electrodes, thereby making it possible to control the landing position of the electron beam on the screen.

According to the above-described image display apparatus, the position of the electron beam passage aperture of a second electrode corresponding to the electron beam passage aperture of a first electrode is changed in accordance with the position on the screen, so that a desired deflection corresponding to the position on the screen is applied to the trajectory of each electron beam which is irradiated onto the screen after passing through the electron beam passage aperture of the first electrode and the electron beam passage aperture of the second electrode. Further, the potential difference between the first and second electrodes is changed to either increase or reduce the quantity of the desired deflection according to the position on the screen, thereby to control the landing pitch of the electron beam which is irradiated onto the screen. Thus, it becomes possible to cancel the deviation between the pitch in the horizontal direction of the electron beam irradiated onto the screen and the phosphor stripe pitch of the screen.

DESCRIPTION OF THE PREFERRED EMBODIMENTS

Figure 4:
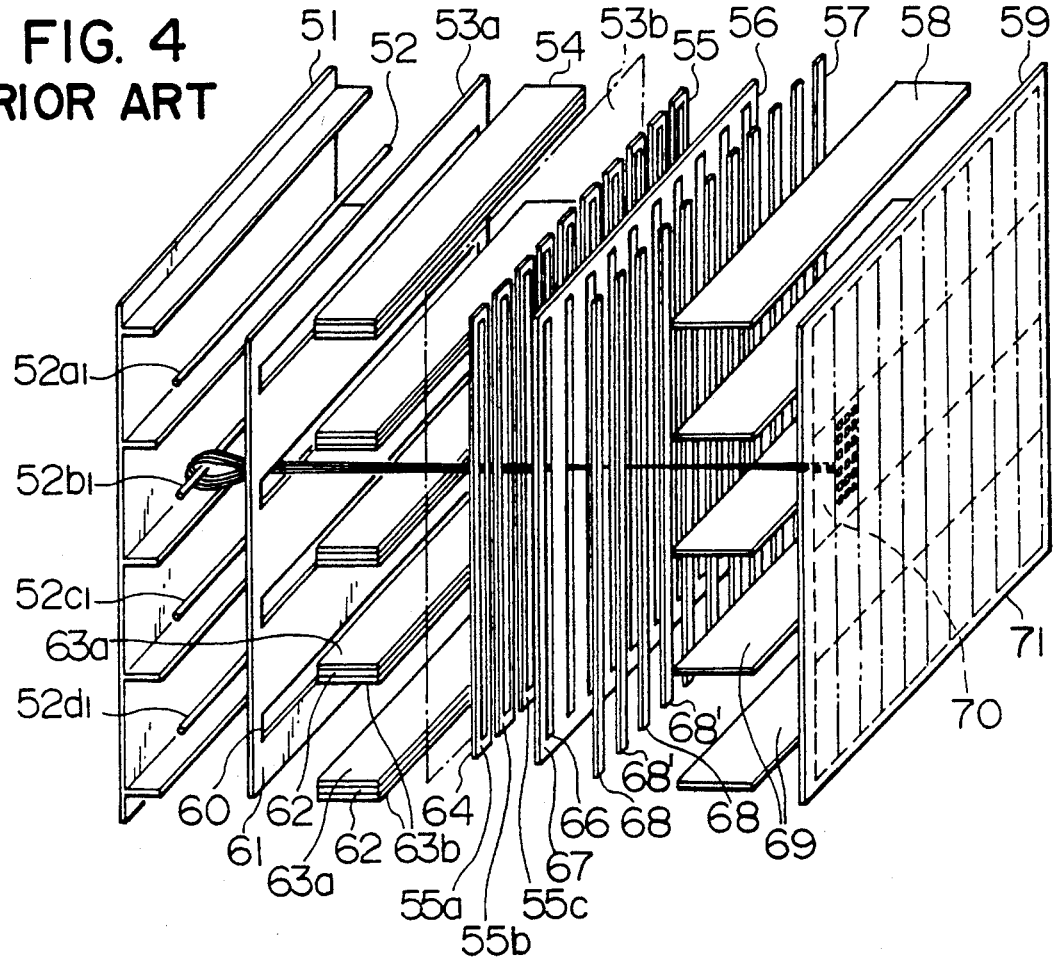
FIG. 4 PRIOR ART
FIG. 4 is a perspective view showing the configuration of the display apparatus.
Figure 5:
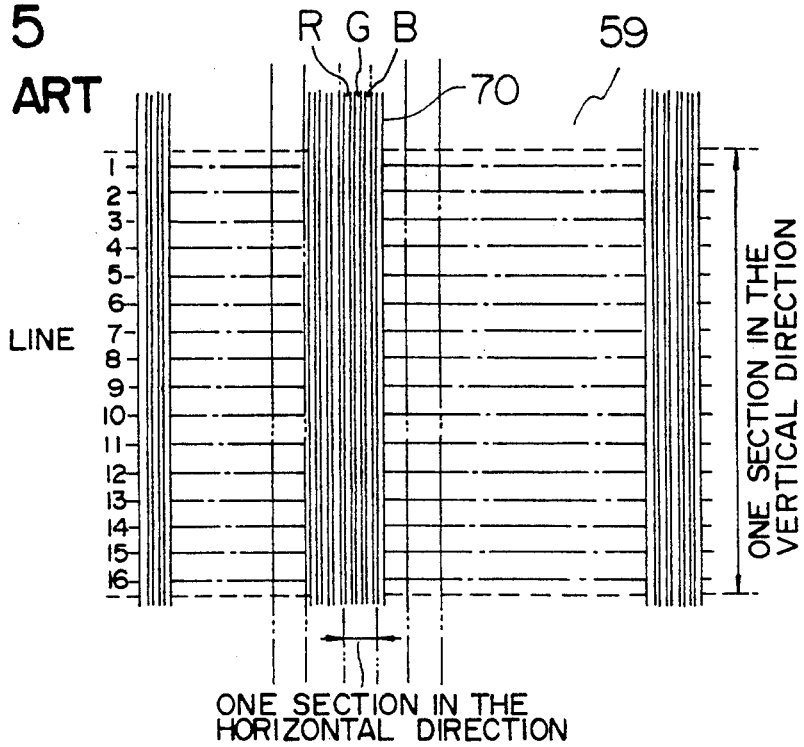
FIG. 5 PRIOR ART
FIG. 5 is an enlarged diagram of a main portion of the phosphor layer on the screen of the same apparatus.

A description will be made of the first embodiment of the present invention. The present embodiment is characterized in that, in the conventional image display apparatus shown in FIG. 4, the horizontal direction pitch of the electron beam passage aperture of the horizontal deflection electrode 57 (that is, the slit between the conductive panels 68) is made slightly larger (for example, 0.05% to 0.2%) than the horizontal direction pitch of the electron beam passage apertures of the other electrodes (that is, the slit 66 of the horizontal focusing electrode 56 and the slit 64 of the beam modulation electrode 55), so that the position of the electron beam passage aperture of the second electrode (that is, the horizontal deflection electrode 57) with respect to the electron beam passage aperture of the first electrode (that is, the horizontal focusing electrode 56 and the beam modulation electrode 55) is changed in accordance with the position on the screen.

Figure 1:
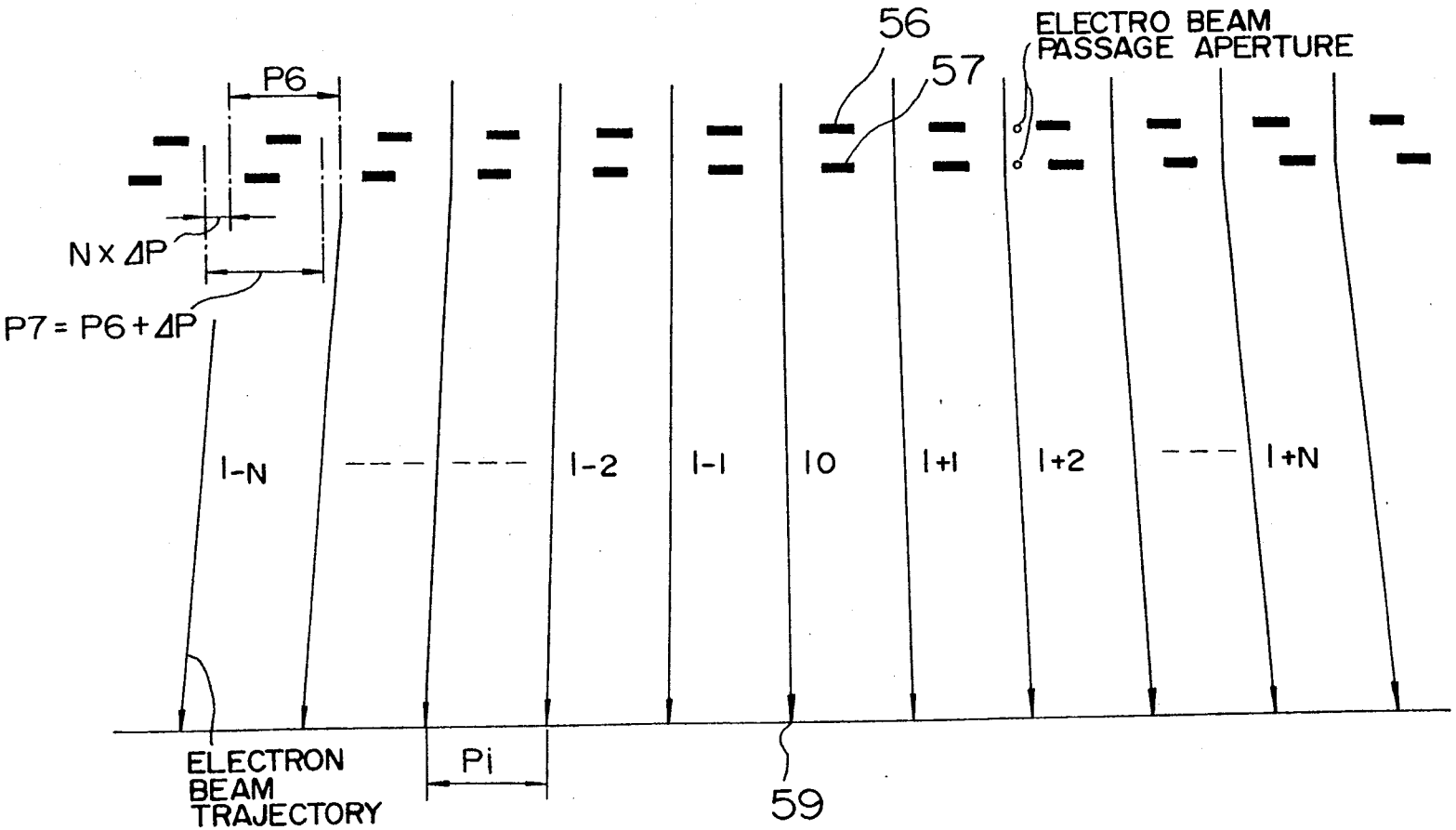
FIG. 1 is a drawing for explaining a first embodiment of the present invention, and this shows a cross section, in the horizontal direction, of the horizontal focusing electrode and horizontal deflection electrode of the display apparatus and the screen section.

FIG. 1 shows a cross section in the horizontal direction of the horizontal focusing electrode 56 and the horizontal deflection electrode 57. The horizontal direction pitch P7 of the electron beam passage aperture of the horizontal deflection electrode 57 (that is, the slit between the conductive panels 68) is made larger by ΔP than the horizontal direction pitch P6 of the electron beam passage aperture of the horizontal focusing electrode 56 (that is, the slit 66), and positional coincidence adjustment is made between the electron beam passage aperture (slit) of the horizontal focusing electrode 56 and the electron beam passage aperture (slit) of the horizontal deflection electrode 57 at the center portion of the horizontal direction of the screen. Accordingly, at the center portion, there is no positional deviation between the electron beam passage aperture (slit) of the horizontal focusing electrode 56 and the electron beam passage aperture (slit) of the horizontal deflection electrode 57. A positional deviation becomes greater in the peripheral direction from the center, and there occurs a positional deviation of N×ΔP at the N-th position from the center (that is, the N-th position of the electron beam passage aperture counted from the center electron beam passage aperture).

Referring to FIG. 1, $1_{-N'}$, ---, $1_{-2'}$, $1_{-1}$, $1_0$, $1_{+1'}$, $1_{+2'}$, ---, $1_{+N}$ designate the trajectories of the electron beams that are irradiated onto the screen 59 after passing through the electron beam passage apertures (slits) of the horizontal focusing electrode 56 and horizontal deflection electrode 57. These trajectories correspond to the positional deviations of the electron beam passage aperture (slit) of the horizontal deflection electrode from the electron beam passage aperture (slit) of the horizontal focusing electrode, and the positional deviation of the horizontal direction landing on the screen 59 (that is, the positional deviation from the horizontal direction position of the electron beam passage aperture (slit) of the horizontal focusing electrode) becomes larger in the direction from the center to the periphery.

Next, by using FIG. 2, a description will be made of the relation among the quantity of positional deviation of the electron beam passage aperture (slit) of the horizontal deflection electrode from the electron beam passage aperture (slit) of the horizontal focusing electrode, the potential difference between the horizontal focusing electrode and the horizontal deflection electrode and the horizontal direction landing pitch of the electron beam on the screen.

Figure 2:
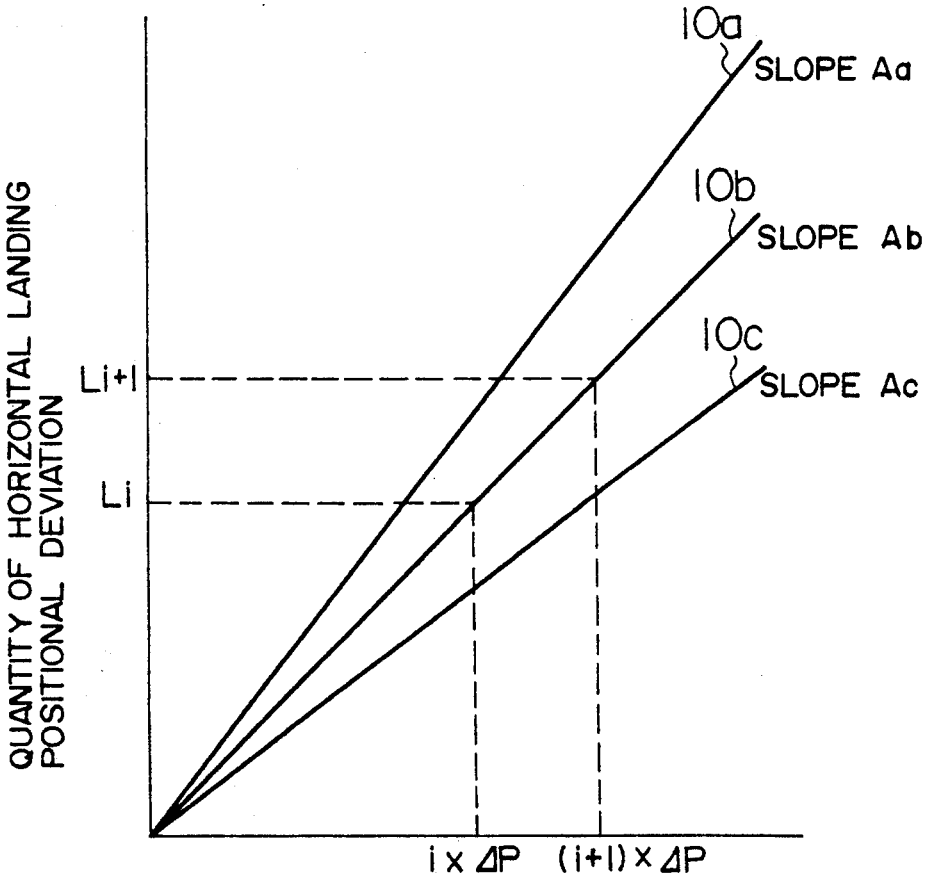
FIG. 2 is a drawing for explaining the first embodiment of the present invention, and this is a characteristic diagram which illustrates the relation among the quantity of positional deviation of the electron beam passage aperture of the horizontal deflection electrode with respect to the electron beam passage aperture of the horizontal focusing electrode, the potential difference between the horizontal focusing electrode and the horizontal deflection electrode, and the horizontal direction landing position of the electron beam on the screen.

In FIG. 2, the abscissa shows quantity of positional deviation of the electron beam passage aperture (slits) between the horizontal focusing electrode and the horizontal deflection electrode, and the ordinate shows quantity of horizontal direction landing positional screen. 10*a*, 10*b* and 10*c* show the relation between the quantity of positional deviation of the electron beam passage aperture (slit) and the quantity of landing positional deviation of the electron beam when the potential difference $V_{f-d}$ between the horizontal focusing electrode and the horizontal deflection electrode is changed to $V_a$, $V_b$ and $V_c$, respectively. Under this condition, the relation between ΔP which is the difference between the horizontal direction pitch P7 of the electron beam passage aperture (slit) of the horizontal deflection electrode and the horizontal direction pitch P6 of the electron beam passage aperture (slit) of the horizontal focusing electrode and the horizontal direction landing pitch $L_p$ of the electron beam on the screen will be considered.

Assume that the positional deviation of the i-th electron beam passage aperture (slit) from the center in the horizontal direction of the screen, that is, the portion of no positional deviation of the electron beam passage aperture (slit), to the screen peripheral direction is i×ΔP, and that the quantity of positional deviation of horizontal direction landing of the electron beam on the screen is $L_i$ when the potential difference between the horizontal focusing electrode and the horizontal deflection electrode is $V_b$. Similarly, assume that the positional deviation of the electron beam passage aperture (slit) at the (i+1) -th position is (i+1)×ΔP and that the quantity of positional deviation in the horizontal direction landing of the electron beam on the screen is $L_{i+1}$. Then, the pitch $P_i$ between the i-th and the (i+1)-th electron beams from the center of the screen to the peripheral direction can be expressed as follows:

$$P_i = L_{i+1} - L_i + P6$$

In FIG. 2, 10*a*, 10*b* and 10*c* are drawn in straight lines. In fact, these can be regarded as almost straight lines when the widths of the electron beam passage apertures (slits) of the horizontal focusing electrode 56 and the horizontal deflection electrode 57, the gap between the two, and voltage conditions are skillfully selected and when the range of the quantity of positional deviation of the electron beam passage aperture (slit) is limited. Therefore, 10*a*, 10*b* and 10*c* are regarded as straight lines in this case. Accordingly, the quantities $L_i$ and $L_{i+1}$ of the positional deviations in the horizontal direction landing of the i-th and the (i+1)-th electron beams from the center of the screen to the peripheral direction, respectively, are as follows:

$$L_i = A_b \times i \times \Delta P$$

$$L_{i+1} = A_b \times (i+1) \times \Delta P$$

where $A_b$ represents the slope of the straight line 10*b*. The pitch $P_i$ between the i-th and the (i+1)-th electron beams is shown as follows:

$$P_i = A_b \times (i+1) \times \Delta P - A_b \times i \times \Delta P + P6$$
$$= A_b \times \Delta P + P6$$

Also consider the case where the potential difference $V_{f-d}$ between the horizontal focusing electrode and the horizontal deflection electrode changes. For example, when $V_{f-d}$ is Va, Pi becomes as follows:

$$Pi = Aa \times \Delta P + P6, \text{ and}$$

when $V_{f-d}$ is Vc, Pi becomes as follows:

$$Pi = Ac + \Delta P + P6$$

where Aa represents the slope of the straight line 10a and Ac represents the slope of the straight line 10c.

In summary, when the pitch of the electron beam passage aperture (slit) of the horizontal deflection electrode is made larger by ΔP than the pitches of the electron beam passage apertures (slits) of the horizontal focusing electrode and other electrodes, the pitch in the horizontal direction of the electron beam to be irradiated onto the screen becomes Ab×ΔP+P6, and this value can be controlled by changing Ab, that is, by adjusting the potential difference $V_{f-d}$ between the horizontal focusing electrode and the horizontal deflection electrode.

More precisely, it has been possible to adjust the slope of a line (almost a straight line) shown in FIG. 2 which represents the relation of the quantity of positional deviation of the electron passage aperture (slit) of the horizontal deflection electrode and to adjust the potential difference between the horizontal focusing electrode and the horizontal deflection electrode and the horizontal direction landing pitch of the electron beam on the screen, in the range of 1 to 5 which indicates the ratio between the scale values of the ordinate and abscissa of the graph shown in FIG. 2 (by changing the potential difference between the two electrodes), by making to have the values of 1 mm for the pitch P6 of the electron beam passage aperture (slit) of the horizontal focusing electrode 56, 0.3 mm for the width of the passage aperture (slit), 0.3 mm for the width of the electron beam passage aperture (slit) of the horizontal deflection electrode 57, 0.4 mm for the gap between the horizontal focusing electrode 6 and the horizontal deflection electrode 57, 20 mm for the gap between the horizontal deflection electrode 58 and the screen 59, about 100V for the voltages applied to the horizontal focusing electrode 56 and the horizontal deflection electrode 57 respectively, and 10 kV for the voltage applied to the screen 59. Therefore, when the pitch difference ΔP between the electron beam passage aperture (slit) of the horizontal focusing electrode and the electron beam passage aperture (slit) of the horizontal deflection electrode is set to 0.001 mm (0.1%), it is possible to adjust the horizontal direction pitch of the electron beam irradiated onto the screen, to be in the range of 1.001 to 1.005 mm. This corresponds to the range of 0.1 to 0.5 mm in terms of the quantity of positional deviation in the horizontal direction landing, on the screen, of the electron beams at both ends of the screen of 200 mm in the horizontal direction.

As described above, according to the present embodiment, it is possible to correct the deviation of the horizontal direction pitch of the electron beam irradiated onto the screen from the phosphor stripe pitch, and to obtain a uniform satisfactory image, accordingly.

In the present embodiment, the horizontal direction pitch of the electron beam passage aperture (slit) of the horizontal deflection electrode 57, that is, the slit between the conductive panels 68, is slightly changed from the horizontal direction pitches of the electron beam passage apertures (slits) of the other electrodes, that is, the slit 66 of the horizontal focusing electrode 56 and the slit 64 of the beam modulation electrode 55. However, it is also possible to change the horizontal direction pitch of the slit 66 of the horizontal focusing electrode 56 or the slit 64 of the beam modulation electrode 55 from the horizontal direction pitches of the electron beam passage apertures (slits) of the other electrodes. It is also possible to obtain the similar effect when the slit 64 of the beam modulation electrode 55, the slit 66 of the horizontal focusing electrode 56 and the slit of the electron beam passage aperture of the horizontal deflection electrode 57, that is, the slit between the conductive panels 68 and 68', are made different from each other.

In the present embodiment, positional coincidence adjustment is made between the electron beam passage apertures (slits) of the horizontal focusing electrode 56 and the electron beam passage apertures (slits) of the horizontal deflection electrode 57 at the center portion in the horizontal direction of the screen. However, it is not always necessary to perform positioning at the center portion of the horizontal direction of the screen, but the positioning may be performed at the left or right end of the screen, for example.

Figure 3:
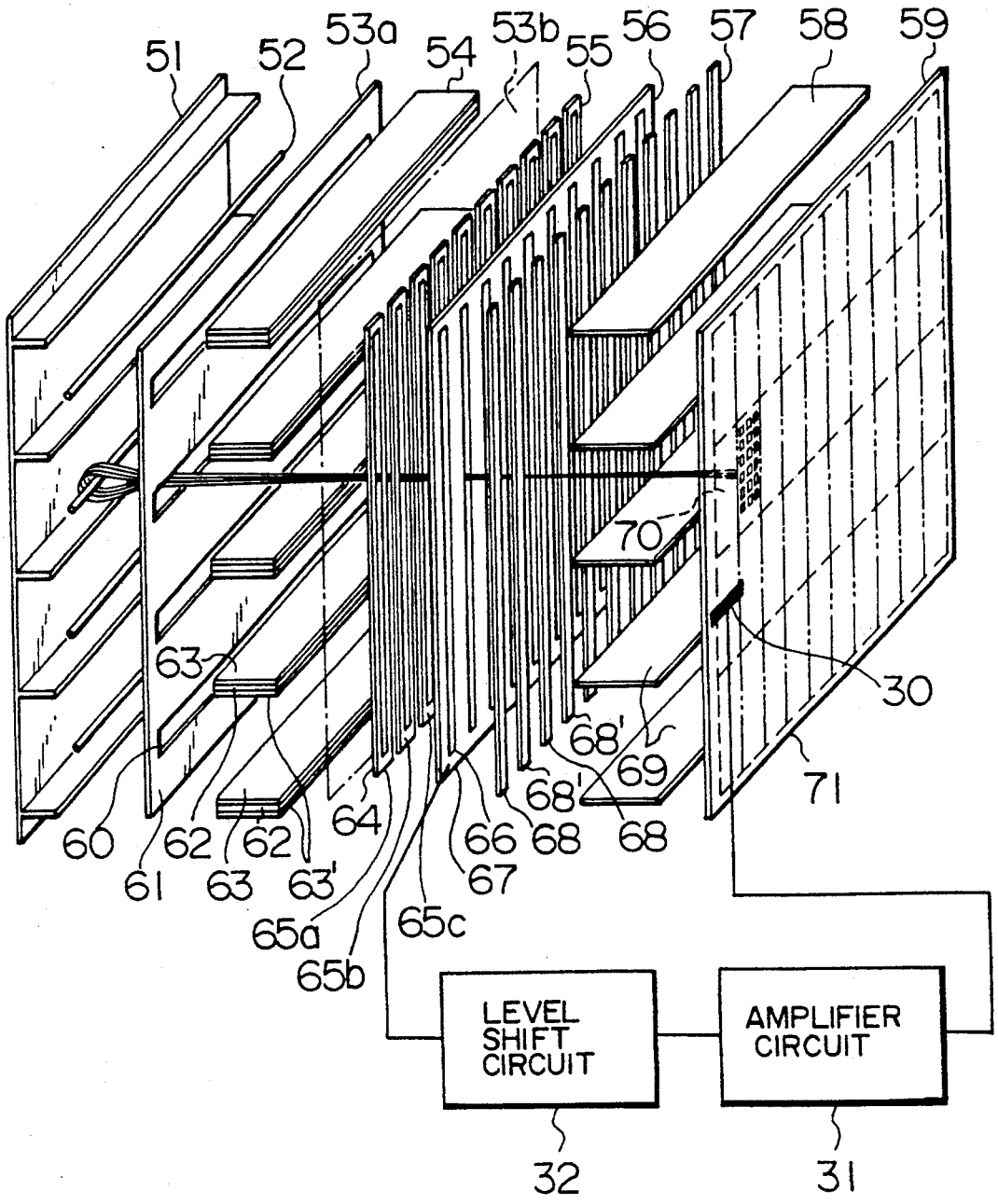
FIG. 3 is a drawing for explaining a second embodiment of the present invention, and this is a perspective view of the configuration of the display apparatus, with a block diagram of the circuit system for feedback controlling the horizontal landing position of the electron beam irradiated onto the screen.

A description will now be made of a second embodiment of the present invention. The present embodiment provides a method for compensating time change of the horizontal direction pitch of the electron beam to be irradiated onto the screen due to temperature change and the like during a period of displaying the image of the display apparatus. FIG. 3 shows the configuration of the embodiment. The display apparatus in the drawing is quite similar to that of the first embodiment, and the corresponding parts are shown by the same reference numerals. In FIG. 3, the horizontal direction pitch of the electron beam passage aperture of the horizontal deflection electrode 57, that is, the slit between the conductive panels 68, is made slightly larger (for example, by about 0.05% to 0.2%) than the horizontal direction pitches of the electron beam passage apertures (slits) of the other electrodes, that is, the slit 66 of the horizontal focusing electrode 56 and the slit 64 of the beam modulation electrode 55. Accordingly, it is possible to adjust the horizontal direction pitch of the electron beam to be irradiated onto the screen by the potential difference between the horizontal focusing electrode 56 and the horizontal deflection electrode 57.

Reference numeral 30 designates a beam landing position detecting means which is provided at a horizontal end portion of the screen 59 to detect the beam landing position in the horizontal direction at the horizontal end portion of the screen 59 (outputs an electric signal corresponding to the landing position). To be more specific, a semiconductor position detecting element (PSD) is used (for, example, S1771 manufactured by Hamamatsu Photonics and the like). The output of the beam landing position detecting means 30 is amplified to a predetermined level by an amplifier circuit 31, biased to several hundred voltages by a level shift circuit 32, and applied to the horizontal focusing electrode 56. In other words, the horizontal direction beam landing position signal is fed back to the horizontal direction beam landing position control means (that is, the horizontal direction positional control of the electron beam to be irradiated onto the screen by the potential difference between the horizontal focusing electrode 56 and the horizontal deflection electrode 57).

Accordingly, by setting the loop gain of the feedback loop to a suitable value, it becomes possible to perform feedback control of the horizontal direction landing position of the electron beam, thereby to compensate time change of the horizontal direction pitch of the electron beam to be irradiated onto the screen.

As described above, according to the present embodiment, it becomes possible to compensate time change of the horizontal direction pitch of the electron beam to be irradiated onto the screen, and to obtain an image which is stable with time.

In the present embodiment, the time change of the horizontal direction pitch of the electron beam to be irradiated onto the screen is detected by using the beam landing position detecting means 30. However, it is also possible to make the quantity of change of the horizontal direction pitch of the electron beam correspond to the temperature at each portion of the image display apparatus when a major portion of the causes of the time change of the horizontal direction pitch of the electron beam is a thermal expansion difference between the electrode group and the screen attributable to a temperature change of the image display apparatus. Accordingly, it is also possible to obtain the similar effect if, in place of the beam landing position detecting means 30, a temperature detecting means such as a thermoelectric couple and the like is disposed at a desired portion of the image display apparatus and the output thereof is fed back to the beam landing position control means in the horizontal direction (that is, the control of the horizontal position of the electron beam to be irradiated onto the screen by the potential difference between the horizontal focusing electrode 56 and the horizontal deflection electrode 57).

According to the present invention, it is possible to cancel the deviation between the horizontal direction pitch of the electron beam to be irradiated onto the screen and the phosphor stripe pitch that is attributable to the positional deviation between the phosphor stripe pattern on the screen and the electrode group which comprises the beam modulation electrode, the horizontal focusing electrode, the horizontal deflection electrode and other electrodes. Thus, by eliminating the above problem of the prior art, it becomes possible to obtain an extremely uniform image which provides a large practical effect.

We claim:

1. An image display apparatus, comprising an electron source for emitting electron beams; a control means for controlling the flow of said electron beams; a display screen irradiated by said electron beams impinging thereon, said control means comprising at least a first electrode having a first arrangement of electron beam passage apertures and a second electrode having a second arrangement of electron beam passage apertures, said second electrode being disposed between said first electrode and said screen, whereby a given electron beam travelling from said electron source to said screen passes through corresponding apertures of said first electrode and said second electrode, and wherein a position of at least one of the apertures of said second electrode is offset laterally with respect to a position of the corresponding aperture of said first electrode relative to a position on said screen; and a beam landing position detecting means provided on the surface of said screen for detecting a beam landing position relative to said screen and generating a beam landing position signal to control a potential difference between said first electrode and said second electrode.

2. An apparatus as in claim 1, wherein positions of said apertures of said second electrode are gradually offset to an increasingly greater extent with respect to the respective positions of the corresponding apertures of said first electrode in a direction extending from a center portion of said screen to a peripheral portion of said screen.

3. An image display apparatus, comprising an electron source for emitting electron beams; a control means for controlling the flow of said electron beams; a display screen irradiated by said electron beams impinging thereon, said control means comprising at least a first electrode having a first arrangement of electron beam passage apertures and a second electrode having a second arrangement of electron beam passage apertures, said second electrode being disposed between said first electrode and said screen, whereby a given electron beam travelling from said electron source to said screen passes through corresponding apertures of said first electrode and said second electrode, and wherein an arrangement pitch of said apertures of said first electrode is different from an arrangement pitch of said apertures of said first electrode; and a beam landing position detecting means provided on the surface of said screen for detecting a beam landing position relative to said screen and generating a beam landing position signal to control a potential difference between said first electrode and said second electrode.

4. An apparatus as in claim 3, wherein positions of at least some of the apertures of said second electrode are offset laterally with respect to positions of respective corresponding apertures of said first electrode relative to predetermined reference positions on said screen.

5. An apparatus as in claim 3, wherein positions of at least some of the apertures of said second electrode are offset laterally with respect to positions of respective corresponding apertures of said first electrode relative to a center position on said screen.

6. An image display apparatus, comprising an electron source for emitting electron beams; a control means for controlling the flow of said electron beams; a display screen irradiated by said electron beams impinging thereon, said control means comprising at least a first electrode having a first arrangement of electron beam passage apertures and a second electrode having a second arrangement of electron beam passage apertures, said second electrode being disposed between said first electrode and said screen, whereby a given electron beam travelling from said electron source to said screen passes through corresponding apertures of said first electrode and said second electrode, and wherein a position of at least one of the apertures of said second electrode is offset laterally with respect to a position of the corresponding aperture of said first electrode relative to a position on said screen; and a temperature detecting means for detecting a temperature at a portion of said image display apparatus and generating a signal based on said detected temperature to control a potential difference between said first electrode and said second electrode.

7. An apparatus as in claim 6, wherein positions of said apertures of said second electrode are gradually offset to an increasingly greater extent with respect to the respective positions of the corresponding apertures of said first electrode in a direction extending from a center portion of said screen to a peripheral portion of said screen.

8. An image display apparatus, comprising an electron source for emitting electron beams; a control means for controlling the flow of said electron beams; a display screen irradiated by said electron beams impinging thereon, said control means comprising at least a first electrode having a first arrangement of electron beam passage apertures and a second electrode having a second arrangement of electron beam passage apertures, said second electrode being disposed between said first electrode and said screen, whereby a given electron beam travelling from said electron source to said screen passes through corresponding apertures of said first electrode and said second electrode, and wherein an arrangement pitch of said apertures of said first electrode is different from an arrangement pitch of said apertures of said first electrode; and a temperature detecting means for detecting a temperature at a portion of said image display apparatus and generating a signal based on said detected temperature to control a potential difference between said first electrode and said second electrode.

9. An apparatus as in claim 8, wherein positions of at least some of the apertures of said second electrode are offset laterally with respect to positions of respective corresponding apertures of said first electrode relative to predetermined reference positions on said screen.

10. An apparatus as in claim 8, wherein positions of at least some of the apertures of said second electrode are offset laterally with respect to positions of respective corresponding apertures of said first electrode relative to a center position on said screen.

* * * * *